US007107968B2

(12) United States Patent
Nomura

(10) Patent No.: US 7,107,968 B2
(45) Date of Patent: Sep. 19, 2006

(54) CONTROL DEVICE OF HIGH-PRESSURE FUEL SYSTEM OF INTERNAL COMBUSTION ENGINE

(75) Inventor: Mitsuhiro Nomura, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/165,296

(22) Filed: Jun. 24, 2005

(65) Prior Publication Data

US 2006/0021598 A1 Feb. 2, 2006

(30) Foreign Application Priority Data

Jul. 30, 2004 (JP) ..... 2004-222773

(51) Int. Cl.
*F02M 69/46* (2006.01)
*F02M 69/54* (2006.01)

(52) U.S. Cl. ..... 123/456; 123/446

(58) Field of Classification Search ..... 123/446, 123/447, 456, 495, 468, 469, 198 DB, 497, 123/496
See application file for complete search history.

(56) References Cited

U.S. PATENT DOCUMENTS 5,230,613 A * 7/1993 Hilsbos et al. ..... 417/439
5,433,182 A 7/1995 Augustin et al.
5,770,796 A * 6/1998 Sakamoto et al. ..... 73/119 A
6,000,380 A * 12/1999 Weisbarth ..... 123/456
6,076,504 A 6/2000 Stavnheim et al.
6,397,819 B1 6/2002 Rembold et al.
6,823,844 B1 * 11/2004 Steinbrenner et al. ..... 123/446
6,899,084 B1 * 5/2005 Miyashita ..... 123/446

FOREIGN PATENT DOCUMENTS

| | | |
|---|---|---|
| DE | 43 35 171 C 1 | 5/1995 |
| DE | 198 23 639 A1 | 12/1999 |
| DE | 199 55 617 A 1 | 6/2001 |
| DE | 100 23 033 A 1 | 11/2001 |
| DE | 103 41 788 A1 | 4/2005 |
| EP | 0 501 459 A2 | 9/1992 |
| EP | 1 251 272 A2 | 10/2002 |
| JP | 04-148057 A | 5/1992 |
| JP | 04-183965 A | 6/1992 |
| JP | 10-077923 A | 3/1998 |
| JP | 10-089135 A | 4/1998 |
| JP | 10-274075 A | 10/1998 |
| JP | 2003-532833 A | 11/2003 |

* cited by examiner

*Primary Examiner*—Mahmoud Gimie
(74) *Attorney, Agent, or Firm*—Oliff & Berridge, PLC

(57) ABSTRACT

An engine ECU performs a program including the steps of calculating an amount of the fuel required to be discharged from high-pressure fuel pumps (the required discharge amount), determining whether one high-pressure fuel pump can be stopped, and if not, determining whether the required discharge amount exceeds a maximum possible discharge amount of one high-pressure fuel pump of smaller capability, and if not, causing the two high-pressure fuel pumps to discharge the fuel in approximately equal amount, or if so, causing the high-pressure fuel pump of smaller capability to discharge the fuel of the maximum possible discharge amount and causing the high-pressure fuel pump of larger capability to discharge the fuel of the amount obtained by subtracting the discharge amount of the high-pressure fuel pump of smaller capability from the required discharge amount.

20 Claims, 4 Drawing Sheets

CONTROL DEVICE OF HIGH-PRESSURE FUEL SYSTEM OF INTERNAL COMBUSTION ENGINE

This nonprovisional application is based on Japanese Patent Application No. 2004-222773 filed with the Japan Patent Office on Jul. 30, 2004, the entire contents of which are hereby incorporated by reference.

BACKGROUND OF THE INVENTION

1. Field of the Invention

The present invention relates to a control device of a high-pressure fuel system of an internal combustion engine that includes fuel injection means (in-cylinder injector) for injecting a fuel into a cylinder at a high pressure, or an internal combustion engine that includes, in addition to the above fuel injection means, fuel injection means (intake manifold injector) for injecting a fuel into an intake manifold or an intake port. More particularly, the present invention relates to a technique for controlling a high-pressure fuel system having a plurality of high-pressure fuel pumps.

2. Description of the Background Art

An engine having a first fuel injection valve (in-cylinder injector) for injecting a fuel into a combustion chamber of a gasoline engine and a second fuel injection valve (intake manifold injector) for injecting a fuel into an intake manifold, and changing a fuel injection ratio between the in-cylinder injector and the intake manifold injector in accordance with the engine speed or the load of the internal combustion engine is known. A direct injection engine having only a fuel injection valve (in-cylinder injector) for injecting a fuel into a combustion chamber of a gasoline engine is also known. In a high-pressure fuel system including the in-cylinder injector, the fuel having its pressure increased by a high-pressure fuel pump is supplied via a delivery pipe to the in-cylinder injector, which injects the high-pressure fuel into a combustion chamber of each cylinder of the internal combustion engine.

Further, a diesel engine having a common rail fuel injection system is also known. In the common rail fuel injection system, the fuel having its pressure increased by a high-pressure fuel pump is stored in a common rail, and injected from the common rail into a combustion chamber of each cylinder of the diesel engine according to opening/closing of an electromagnetic valve.

To obtain the fuel of a high pressure in such internal combustion engines, a high-pressure fuel pump is used which has a cylinder driven by a cam provided at a driveshaft that is connected to a crankshaft of the internal combustion engine.

Japanese Patent Laying-Open No. 10-274075 discloses a cylinder injection internal combustion engine provided with cam-driven fuel pumps, which prevents variation in fuel amount among the cylinders due to discharge pulsation caused by the cam-driven fuel pumps. The cylinder injection internal combustion engine includes first and second cam-driven high-pressure fuel pumps that each perform suction and discharge of a fuel with a reciprocating motion of a plunger, slidably arranged in a pump housing, driven by a cam. The first high-pressure fuel pump is provided with a first discharge part that discharges the fuel at a first discharge timing. The second high-pressure fuel pump is provided with a second discharge part that discharges the fuel at a second discharge timing that has a desired phase difference $\Theta$ with respect to the first discharge-timing. Fuel injection valves include a first injection valve group that is branched on the downstream of the high-pressure fuel pumps and is supplied with the fuel at the first discharge timing, and a second injection valve group that is supplied with the fuel at the second discharge timing. With a pump speed reduction ratio represented by J and the number of cylinders of the engine represented by K, the number Y of cam crests at the cam part is set to satisfy $Y \times J = K/4$, and phase difference $\Theta$ is set to satisfy $\Theta/J = 720/K$.

According to this cylinder injection internal combustion engine, the very simple configuration of providing two cam-driven high-pressure fuel pumps and setting the number of cam crests as well as the phase difference between the two high-pressure fuel pumps makes it possible to synchronize the pump pulsation cycles with the fuel injection cycles of the fuel injection valves, even in an engine having a large number of cylinders of which application is difficult. Accordingly, even in the event of large fluctuations of the fuel pressure due to the pump pulsation, the fuel injection pressure at the time of fuel injection becomes approximately equal among the cylinders, and the fuel of an approximately equal amount is injected from each cylinder. This also suppresses variation in air-fuel ratio among the cylinders.

Japanese Patent National Publication No. 2003-532833 discloses a fuel amount control system for an internal combustion engine having a particularly large combustion chamber or for an internal combustion engine having more than four cylinders, which ensures highly reliable fuel supply to a combustion chamber. The fuel amount control system includes a fuel reserve tank, at least one pre-feed pump, a high-pressure fuel pump device provided with at least two high-pressure fuel pumps for delivering a fuel from a low-pressure area to at least one high-pressure accumulator, a control device for controlling an injection pressure formed within the high-pressure accumulator, and a plurality of fuel injection valves for injecting the fuel from the high-pressure accumulator into a plurality of combustion chambers of the internal combustion engine. The fuel amount control system has a single fuel circuit for controlling the amounts of the fuel to be supplied to the combustion chambers of the internal combustion engine. The high-pressure fuel pumps are all arranged in this fuel circuit, and the fuel circuit controls the high-pressure fuel pumps independently from each other using a single pressure control circuit commonly provided.

In this fuel amount control system, only one fuel circuit, rather than a plurality of fuel circuits, is provided for controlling the amounts of the fuel supplied to every combustion chambers of the internal combustion engine, and the high-pressure fuel pumps of the high-pressure fuel pump device are all arranged in this fuel circuit. The control device of the fuel amount control system controls the high-pressure fuel pumps independently from each other via one common pressure control circuit. There is only one high-pressure accumulator arranged in the fuel circuit. The injection pressure of this high-pressure accumulator can be controlled with the single pressure control circuit. As such, a fuel amount control system ensuring highly reliable fuel supply to the combustion chambers can be implemented inexpensively with a particularly simple configuration.

However, although Japanese Patent Laying-Open No. 10-274075 and Japanese Patent National Publication No. 2003-532833 both disclose configuration of a high-pressure fuel system with a plurality of (two) high-pressure fuel pumps, they fail to disclose how to control the plurality of high-pressure fuel pumps in a cooperative manner so as to obtain a desired discharge pressure.

SUMMARY OF THE INVENTION

The present invention has been made to solve the above-described problem, and an object of the present invention is to provide a control device of a high-pressure fuel system of an internal combustion engine having a plurality of high-pressure fuel pumps, which can control the high-pressure fuel pumps in a cooperative manner.

A control device according to the present invention controls a high-pressure fuel system of an internal combustion engine having a fuel injection mechanism for injecting a fuel into a cylinder. The high-pressure fuel system includes a plurality of high-pressure fuel pumps driven by the internal combustion engine. The control device includes: a detection unit for detecting an amount of the fuel required to be discharged from the high-pressure fuel pumps; and a control unit for controlling the plurality of high-pressure fuel pumps such that the fuel discharged from the plurality of high-pressure fuel pumps is supplied to a plurality of such fuel injection mechanisms. The control unit includes a discharge ratio determination portion that determines a fuel discharge ratio among the plurality of high-pressure fuel pumps in accordance with the amount of the fuel required to be discharged.

According to this invention, the amount of the fuel required to be discharged from the high-pressure fuel pumps is detected by calculation based on a required fuel injection amount and fluctuation in fuel pressure. The high-pressure fuel pumps, increasing the fuel pressure to about 13 MPa, will cause noise and vibration. Thus, during idling or the like where the load of the internal combustion engine is small, the discharge ratio determination portion determines the fuel discharge ratio among the plurality of high-pressure fuel pumps so as to activate the minimum number of high-pressure fuel pumps required. This can improve the overall efficiency of the high-pressure fuel system formed of the high-pressure fuel pumps since unnecessary pumps are not activated. This also ensures that each high-pressure fuel pump is activated at a proper load, since the fuel discharge ratio among the high-pressure fuel pumps can be determined as appropriate. Accordingly, reliability of the high-pressure fuel pumps can be increased. Furthermore, even in the case where the high-pressure fuel pumps have different characteristics (different discharge amounts), overall control of the pumps is possible, so that the high-pressure fuel system of a high level of safety can be implemented. As a result, it is possible to provide a control device of a high-pressure fuel system of an internal combustion engine having a plurality of high-pressure fuel pumps that can control the high-pressure fuel pumps in a cooperative manner.

Preferably, the control device further includes a storage unit for storing a characteristic of each of the high-pressure fuel pumps. In this case, the discharge ratio determination portion determines the fuel discharge ratio among the plurality of high-pressure fuel pumps in accordance with the amount of the fuel required to be discharged, based on the characteristics.

According to this invention, a fuel discharge amount of each pump, for example, may be stored. This makes it possible to determine the fuel discharge ratio among the plurality of high-pressure fuel pumps as appropriate. For example, it is possible to determine which pump is to be activated, or make the pumps discharge the fuel in equal amount.

Still preferably, the discharge ratio determination portion calculates an amount of the fuel to be discharged from each of the high-pressure fuel pumps based on the fuel discharge ratio, and calculates a drive duty of each of the high-pressure fuel pumps based on the amount of the fuel to be discharged therefrom.

According to this invention, the high-pressure fuel pumps are controlled using the drive duties. This ensures highly accurate control of the fuel discharge ratio among the high-pressure fuel pumps as well as the fuel discharge amounts of the high-pressure fuel pumps. Accordingly, the combustion state of the fuel in the internal combustion engine can be controlled appropriately, and thus, fuel efficiency, exhaust emission, and drivability can be maintained at favorable states.

Still preferably, the discharge ratio determination portion determines the fuel discharge ratio among the plurality of high-pressure fuel pumps in accordance with the amount of the fuel required to be discharged, with an amount of the fuel relieved from the high-pressure fuel pumps being taken into account.

According to this invention, in order to suppress fuel leakage from the fuel injection mechanism while the internal combustion engine is stopped, the high-pressure fuel in the high-pressure fuel system is returned to the fuel tank by the relief function (leakage function) provided to the check valve arranged between the high-pressure fuel pump and the high-pressure delivery pipe, for example. (As an example of the relief function, the check valve is provided with pores that remain always open, through which the high-pressure fuel flows toward the fuel tank upon occurrence of a pressure difference when the high-pressure fuel pump is not activated). The (relieved) amount of the fuel because of this relief function is taken into account when calculating the amount of the fuel required to be discharged from the high-pressure fuel pumps, ensuring accurate calculation thereof Still preferably, the control unit determines whether it is possible to stop discharge of the fuel from at least one of the high-pressure fuel pumps in accordance with the amount of the fuel required to be discharged.

According to this invention, it is determined whether at least one high-pressure fuel pump can be stopped, based on the overall discharge amount of the high-pressure fuel pumps and the required discharge amount thereof. At this time, since the (relived) amount of the fuel because of the relief function is taken into account, overload corresponding to the relieved amount of the fuel will not be imposed on the pump other than the one from which discharge is stopped. This can improve reliability of the entire high-pressure fuel system.

Still preferably, the control unit controls the high-pressure fuel pumps such that discharge of the fuel from at least one of the high-pressure fuel pumps is stopped when fuel injection from the fuel injection mechanism is stopped.

According to this invention, during the time when fuel injection from the fuel injection mechanism is stopped (during the fuel cut or the like), only one or some of the plurality of high-pressure fuel pumps are activated so as to maintain a high fuel pressure, while discharge of the fuel from at least one remaining high-pressure fuel pump is stopped. At this time, although one or some of the plurality of high-pressure fuel pumps are activated in order to ensure a quick increase of the fuel pressure to the level required to be supplied to the fuel injection mechanism at the start (restart) of the fuel injection, it can be determined to stop discharge of the fuel from at least one remaining high-pressure fuel pump. Still preferably, when the plurality of high-pressure fuel pumps include a high-pressure fuel pump having a different discharge characteristic, the discharge ratio determination portion determines the fuel discharge ratio among the plurality of high-pressure fuel pumps such that the amount of the fuel discharged from the high-pressure fuel pump having the different discharge characteristic is approximately equal to the amount of the fuel discharged from another one of the high-pressure fuel pumps.

According to this invention, it is possible to make the plurality of high-pressure fuel pumps discharge the fuel in approximately equal amount. This can prevent pulsation sound due to fluctuation in discharge pulsation, and steady pulsation sound is ensured. As such, abnormal noise due to the pulsation can be reduced. Further, variation in injection amount due to the pulsation can also be suppressed.

Still preferably, when at least one of the plurality of high-pressure fuel pumps has a maximum possible discharge amount that is smaller than the amount of the fuel required to be discharged, the discharge ratio determination portion determines the fuel discharge ratio among the plurality of high-pressure fuel pumps such that the high-pressure fuel pump having its maximum possible discharge amount smaller than the amount of the fuel required to be discharged will discharge the fuel of the maximum possible discharge amount and that another one of the high-pressure fuel pumps will discharge the fuel of the amount corresponding to a difference between the amount of the fuel required to be discharged and the maximum possible discharge amount.

According to this invention, even in the case where the required discharge amount exceeds the discharge amount (discharge capability) of one pump, the fuel discharge ratio among the high-pressure fuel pumps can be set to cause another high-pressure fuel pump of enough capability to discharge the fuel of the extra amount. This ensures that the high-pressure fuel system as a whole discharges the required discharge amount appropriately.

A control device according to another aspect of the present invention controls a high-pressure fuel system of an internal combustion engine having a fuel injection mechanism for injecting a fuel into a cylinder. The high-pressure fuel system includes a plurality of high-pressure fuel pumps driven by the internal combustion engine. This control device includes: a detection unit for detecting a pressure of a fuel supplied from the high-pressure fuel pump; a control unit for activating the plurality of high-pressure fuel pumps one by one using a predetermined drive duty; and a determination unit for determining whether the pump is faulty or not based on a change in fuel pressure as a result of the activation.

According to this invention, it is possible to determine faulty pumps from among the plurality of high-pressure fuel pumps in a simple manner, by activating the high-pressure fuel pumps one by one by a predetermined drive duty.

Preferably, the determination unit determines whether the pump is faulty or not based on a degree of increase of the fuel pressure.

According to this invention, it is possible to determine that the pump is faulty when the fuel pressure does not increase corresponding to the drive duty.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
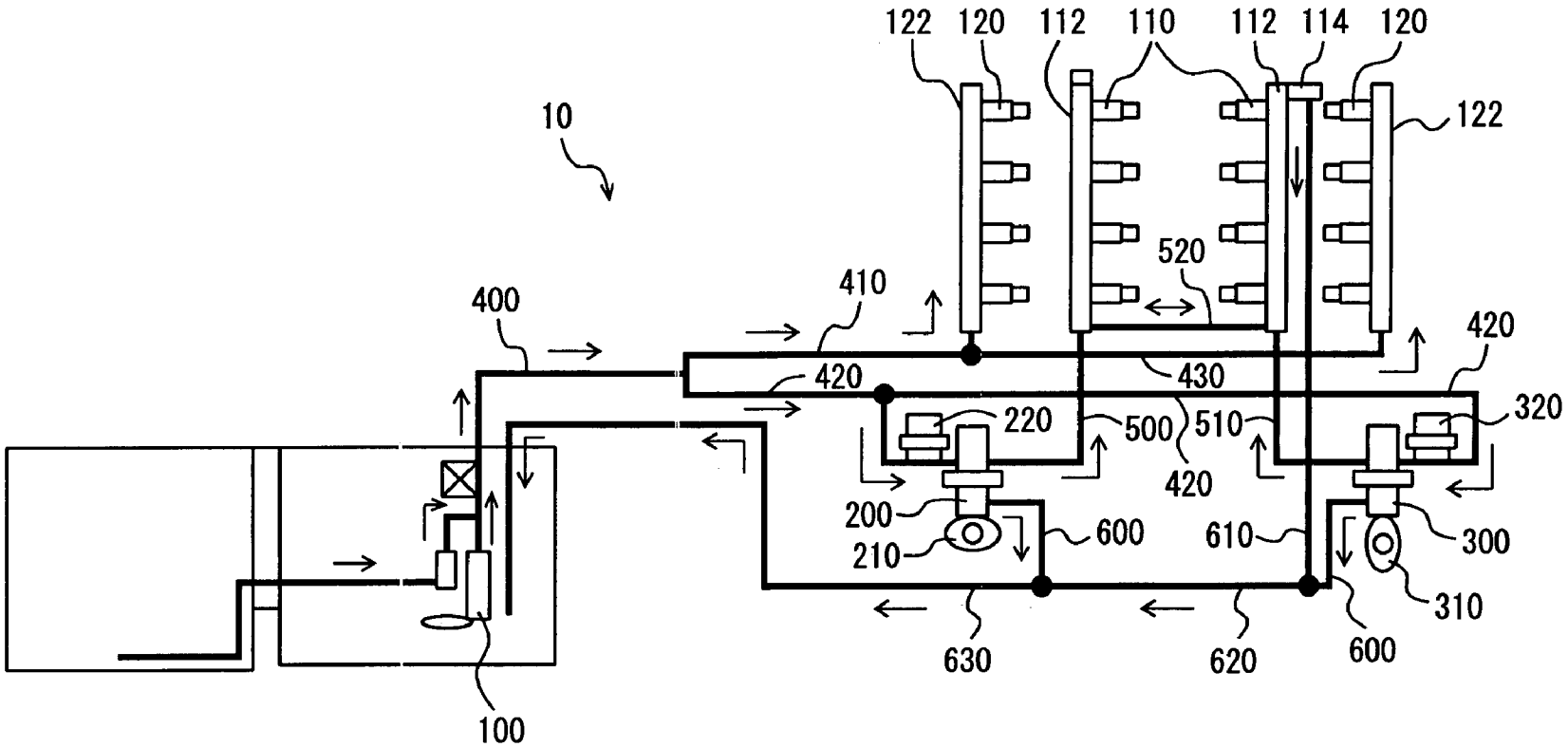
FIG. 1 is an overall schematic view of a fuel supply system of a gasoline engine controlled by a control device according to an embodiment of the present invention.

Hereinafter, embodiments of the present invention will be described with reference to the drawings. In the following description, the same reference characters denote the same portions having the same names and functions. Thus detailed description thereof will not be repeated.

FIG. 1 shows a fuel supply system 10 of an engine controlled by an engine ECU (Electronic Control Unit) that is a control device according to an embodiment of the present invention. The engine is a V-type 8-cylinder gasoline engine, and has in-cylinder injectors 110 for injecting the fuel into the respective cylinders, and intake manifold injectors 120 for injecting the fuel into intake manifolds of the respective cylinders. It is noted that the present invention is not applied exclusively to such an engine, but is also applicable to a gasoline engine of another type and a common rail diesel engine. Further, the number of high-pressure fuel pumps is not restricted to two, but may be any number of more than one.

As shown in FIG. 1, this fuel supply system 10 includes a feed pump 100 provided in a fuel tank and for supplying a fuel at a discharge pressure of low pressure (about 400 kPa corresponding to the pressure of a pressure regulator), a first high-pressure fuel pump 200 driven by a first cam 210, a second high-pressure fuel pump 300 driven by a second cam 310 having a discharge phase different from that of first cam 210, a high-pressure delivery pipe 112 provided for each of left and right banks and for supplying a high-pressure fuel to in-cylinder injectors 110, four in-cylinder injectors 110 for each of the left and right banks, provided at the corresponding high-pressure delivery pipe 112, a low-pressure delivery pipe 122 provided for each of the left and right banks and for supplying a fuel to intake manifold injectors 120, and four intake manifold injectors 120 for each of the left and right banks, provided at the corresponding low-pressure delivery pipe 122.

The discharge port of feed pump 100 in the fuel tank is connected to a low-pressure supply pipe 400, which is branched into a first low-pressure delivery connection pipe 410 and a pump supply pipe 420. First low-pressure delivery connection pipe 410 is branched to low-pressure delivery pipe 122 of one of the V-shaped banks, and on the downstream of that branch point, it forms a second low-pressure delivery connection pipe 430, which is connected to low-pressure delivery pipe 122 of the other bank.

Pump supply pipe 420 is connected to intake ports of first and second high-pressure fuel pumps 200 and 300. A first pulsation damper 220 and a second pulsation damper 320 are provided immediately upstream of the intake ports of first and second high-pressure fuel pumps 200 and 300, respectively, so as to reduce fuel pulsation.

The discharge port of first high-pressure fuel pump 200 is connected to a first high-pressure delivery connection pipe 500, which is connected to high-pressure delivery pipe 112 of one of the V-shaped banks. The discharge port of second high-pressure fuel pump 300 is connected to a second high-pressure delivery connection pipe 510, which is connected to high-pressure delivery pipe 112 of the other bank. High-pressure delivery pipe 112 of one bank and high-pressure delivery pipe 112 of the other bank are connected via a high-pressure connection pipe 520.

A relief valve 114 provided at high-pressure delivery pipe 112 is connected via a high-pressure delivery return pipe 610 to a high-pressure fuel pump return pipe 600. The return ports of high-pressure fuel pumps 200 and 300 are connected to high-pressure fuel pump return pipe 600. High-pressure fuel pump return pipe 600 is connected to return pipes 620 and 630, and then connected to the fuel tank.

Figure 2:
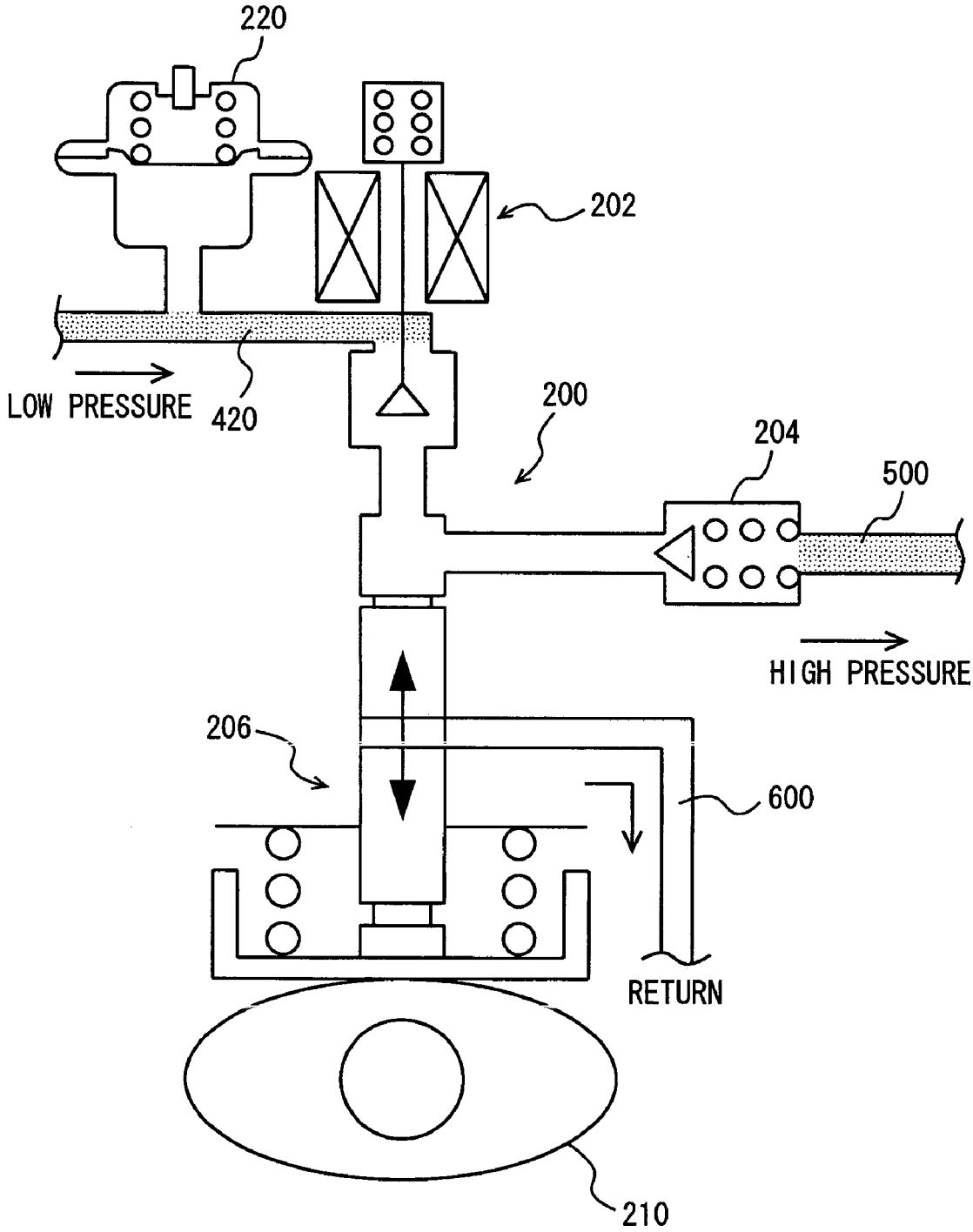
FIG. 2 is a partial enlarged view of FIG. 1.

FIG. 2 is an enlarged view of first high-pressure fuel pump 200 and its surroundings in FIG. 1. Although second high-pressure fuel pump 300 has the similar configuration, they are different in phase of the cams and hence different in phase of the discharge timings, thereby suppressing occurrence of pulsation. First and second high-pressure fuel pumps 200 and 300 may have characteristics similar to or different from each other. In the following explanation, it is assumed that first high-pressure fuel pump 200 has discharge capability that is smaller than discharge capability of second high-pressure fuel pump 300. Such data is stored in a memory of the engine ECU.

High-pressure fuel pump 200 has, as its main components, a pump plunger 206 driven by a cam 210 to slide up and down, an electromagnetic spill valve 202, and a check valve 204 provided with a leakage function.

When pump plunger 206 is moved downward by cam 210 and while electromagnetic spill valve 202 is open, the fuel is introduced (suctioned). When pump plunger 206 is moved upward by cam 210, the timing to close electromagnetic spill valve 202 is changed to control the amount of the fuel discharged from high-pressure fuel pump 200. During the pressurizing stroke in which pump plunger 206 is moved upward, the fuel of a greater amount is discharged as the timing to close electromagnetic spill valve 202 is earlier, whereas the fuel of a fewer amount is discharged as the timing to close the valve is later. The drive duty of electromagnetic spill valve 202 when the greatest amount of fuel is discharged is set to 100%, and the drive duty of electromagnetic spill valve 202 when the smallest amount of fuel is discharged is set to 0%. When the drive duty is 0%, electromagnetic spill valve 202 remains open, in which case, although pump plunger 206 slides up and down as long as first cam 210 continues to rotate (along with rotation of the engine), the fuel is not pressurized because electromagnetic spill valve 202 does not close.

The pressurized fuel presses and opens check valve 204 provided with the leakage function (of the set pressure of about 60 kPa), and the fuel is delivered via first high-pressure delivery connection pipe 500 to high-pressure delivery pipe 112. At this time, the fuel pressure is controlled in a feedback manner by a fuel pressure sensor provided at high-pressure delivery pipe 112. High-pressure delivery pipes 112 at the respective banks are connected via high-pressure connection pipe 520, as described above.

Check valve 204 with the leakage function is a check valve of a normal type but provided with pores that are always open. When the fuel pressure within first high-pressure fuel pump 200 (pump plunger 206) becomes lower than the fuel pressure within first high-pressure delivery connection pipe 500 (for example, when the engine and hence cam 210 stops while electromagnetic spill valve 202 remains open), the high-pressure fuel within first high-pressure delivery connection pipe 500 returns through the pores back to the high-pressure fuel pump 200 side, thereby lowering the fuel pressure within high-pressure delivery connection pipe 500 as well as within high-pressure delivery pipe 112. As such, at the time of stop of the engine, for example, the fuel within high-pressure delivery pipe 112 is not a high pressure, so that leakage of the fuel from in-cylinder injectors 110 is prevented.

Figure 3:
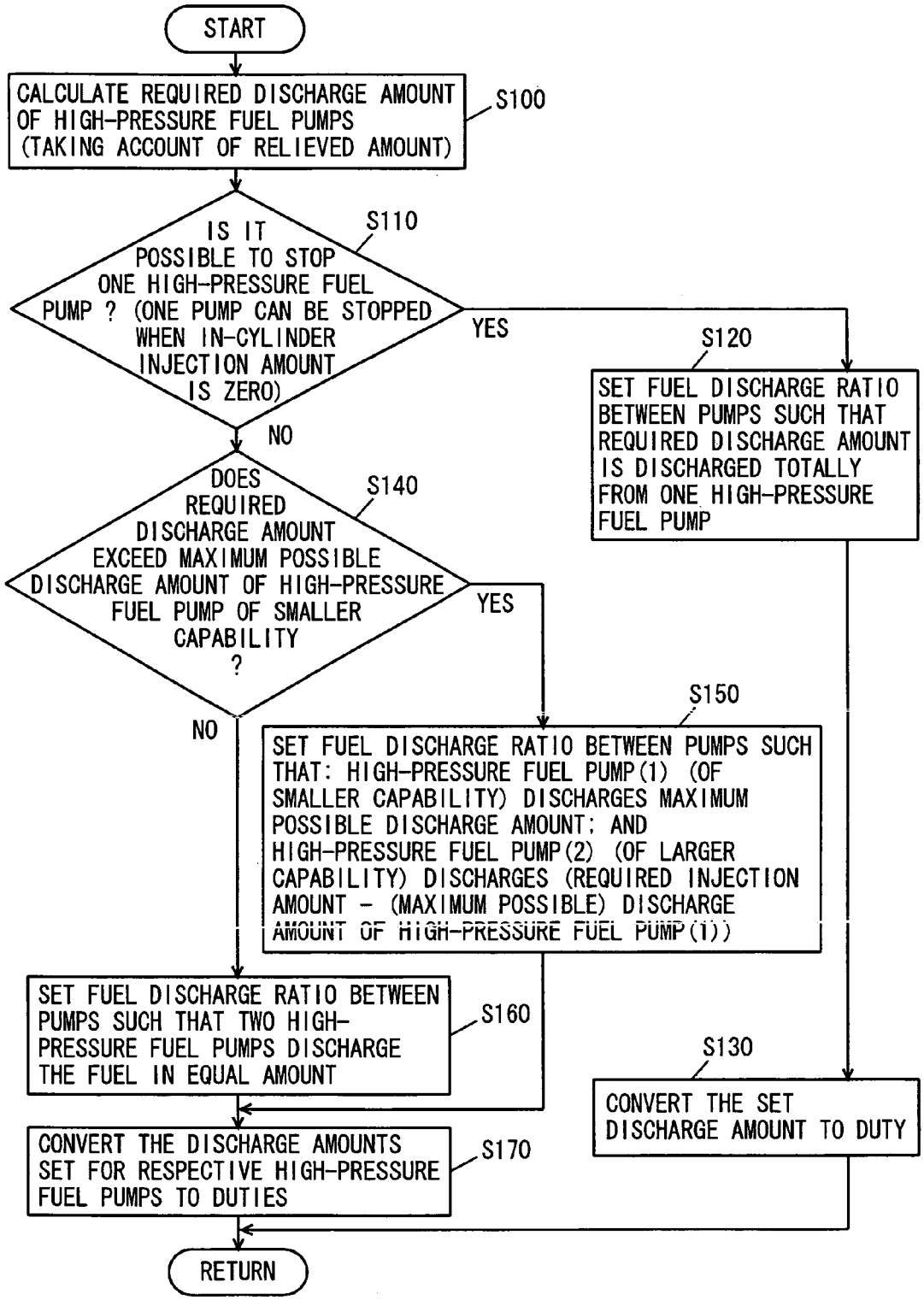
FIGS. 3 and 4 are flowcharts each illustrating a control structure of a program executed by an engine ECU.

Hereinafter, a control structure of a program executed by the engine ECU implementing the control device according to the present embodiment will be described with reference to FIG. 3.

In step (hereinafter, abbreviated as "S") 100, the engine ECU calculates an amount of the fuel required to be discharged from the high-pressure fuel pumps (hereinafter, also referred to as a "required discharge amount of the high-pressure fuel pumps"). At this time, the amount of the fuel relieved from check valve 204 with the leakage function is taken into account as well. In S110, the engine ECU determines whether it is possible to stop one of the two high-pressure fuel pumps. For example, it is determined that one high-pressure fuel pump can be stopped when the amount of the fuel injected into the cylinder by in-cylinder injector 110 is zero. When it is determined that one of the high-pressure fuel pumps can be stopped (YES in S110), the process goes to S120. If not (NO in S110), the process goes to S140.

In S120, the engine ECU sets the fuel discharge ratio between the two high-pressure fuel pumps such that the required discharge amount of the high-pressure fuel pumps is discharged totally from one high-pressure fuel pump that is not stopped. In S130, the engine ECU converts the discharge amount set for the high-pressure fuel pump in S120 to a duty.

In S140, the engine ECU determines whether the required discharge amount of the high-pressure fuel pumps exceeds a maximum possible discharge amount of first high-pressure fuel pump 200 of smaller capability. If the required discharge amount exceeds the maximum possible discharge amount of first high-pressure fuel pump 200 of smaller capability (YES in S140), the process goes to S150. If not (NO in S140), the process goes to S160.

In S150, the engine ECU sets the fuel discharge ratio between the two high-pressure fuel pumps as follows. The discharge amount of first high-pressure fuel pump 200 (of smaller capability) is set to its maximum possible discharge amount, and the discharge amount of second high-pressure fuel pump 300 (of larger capability) is set to: (required discharge amount—(maximum possible) discharge amount of first high-pressure fuel pump 200). The process then goes to S170.

In S160, the engine ECU sets the fuel discharge ratio between the two high-pressure fuel pumps such that they discharge the fuel of equal or approximately equal amounts. In S170, the discharge amounts set for the respective high-pressure fuel pumps are converted to duties.

An operation of the fuel supply system of an engine controlled by the engine ECU implementing the control device of the present embodiment based on the above-described structure and flowchart will now be described.

The amount of the fuel required to be discharged from the high-pressure fuel pumps (i.e., the required discharge amount of the high-pressure fuel pumps) is calculated based on the engine speed, engine load and the like, with the amount of the fuel relieved from check valve 204 having the leakage function taken into account (S100). When the amount of the fuel injected from in-cylinder injector 110 is zero during fuel cut, idling or the like, it is determined that one of the pumps can be stopped (YES in S110). In this case, the fuel discharge ratio between the pumps is set such that the required discharge amount of the high-pressure fuel pumps is discharged by only one high-pressure fuel pump (S120), and the relevant discharge amount is converted to a duty (S130).

If it is determined that one of the high-pressure fuel pumps cannot be stopped (NO in S110), it is determined whether the required discharge amount of the high-pressure fuel pumps exceeds a maximum possible discharge amount of first high-pressure fuel pump 200 of smaller capability (S140). If the required discharge amount exceeds the maximum possible discharge amount of first high-pressure fuel pump 200 of smaller capability (YES in S140), the fuel discharge ratio between the pumps is set such that first high-pressure fuel pump 200 (of small capability) will discharge the fuel of its maximum possible discharge amount and second high-pressure fuel pump 300 (of large capability) will discharge the fuel of an amount obtained by subtracting the (maximum possible) discharge amount of first high-pressure fuel pump 200 from the required discharge amount of the high-pressure fuel pumps.

If the required discharge amount of the high-pressure fuel pumps is smaller than the maximum possible discharge amount of first high-pressure fuel pump 200 of smaller capability (NO in S140), then the fuel discharge ratio between the pumps is set such that the two pumps will discharge the fuel in equal (or approximately equal) amount.

When both high-pressure fuel pumps are to be used, the discharge amounts set for the respective high-pressure fuel pumps are converted to duties (S170).

The engine ECU transmits control signals corresponding to the converted duties to the electromagnetic spill valves, so as to control the amounts of the fuel discharged from high-pressure fuel pumps 200 and 300.

As described above, according to the fuel supply system of an engine controlled by the engine ECU implementing the control device of the present embodiment, the amount of the fuel required to be discharged from the high-pressure fuel pumps is calculated with the amount of the fuel relieved from the check valve having the leakage function being taken into account. As such, even in the case where only one of the pumps is activated while the amount of the relieved fuel increases as the other pump is stopped, the amount of the relieved fuel is included in the calculation, and thus, it is possible to calculate the required discharge amount so as not to induce overload. Further, the system allows only one of the high-pressure fuel pumps to operate when it is possible to stop the other pump. Still further, the fuel discharge ratio between the two high-pressure pumps is set to cause the two pumps to discharge the fuel in equal (or approximately equal) amount until the amount of the fuel required to be discharged from the high-pressure fuel pumps exceeds a maximum possible discharge amount of the pump of smaller capability. When the amount of the fuel required to be discharged from the high-pressure fuel pumps exceeds the maximum possible discharge amount of the high-pressure fuel pump of smaller capability, the fuel discharge ratio between the pumps is set such that the high-pressure fuel pump of smaller capability discharges the fuel of its maximum possible discharge amount and the high-pressure fuel pump of larger capability discharges the fuel of the amount obtained by subtracting the discharge amount of the high-pressure fuel pump of smaller capability from the amount of the fuel required to be discharged from the high-pressure fuel pumps. Accordingly, the overall efficiency of the fuel supply system as well as safety thereof can be improved, and the cooperative control of the plurality of high-pressure fuel pumps becomes possible.

MODIFICATION

Hereinafter, a control device according to a modification of the present invention will be described. The control device according to the modification executes a program that is different from the one executed in the above-described embodiment. Otherwise, the hardware configuration (FIGS. 1 and 2) is identical, so that detailed description thereof will not be repeated.

Figure 4:
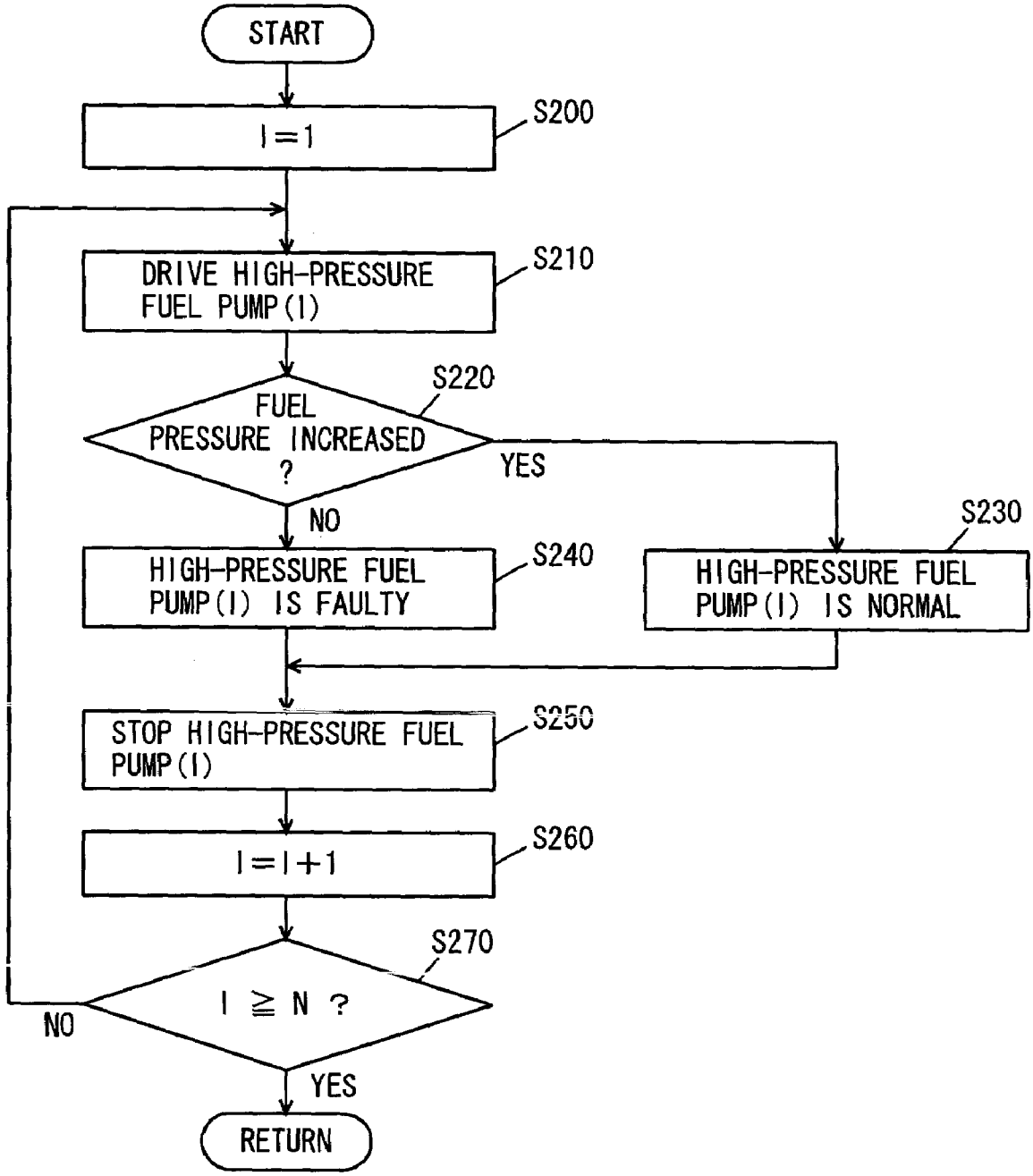

A control structure of a program executed by an engine ECU implementing the control device according to the modification will now be described with reference to FIG. 4. Hereinafter, the number of high-pressure fuel pumps is set to N.

In S200, the engine ECU initializes the variable I(I=1). In S210, the engine ECU drives a high-pressure fuel pump (I). At this time, a predetermined duty is transmitted to electromagnetic spill valve 202. In S220, the engine ECU determines whether the fuel pressure has been increased. The determination is made based on a signal input to the engine ECU from a fuel pressure sensor provided at high-pressure delivery pipe 500. If the fuel pressure has been increased (YES in S220), the process goes to S230. If not (NO in S220), the process goes to S240.

In S230, the engine ECU determines that the high-pressure fuel pump (I) is normal. The process then goes to S250.

In S240, the engine ECU determines that the high-pressure fuel pump (I) is faulty.

In S250, the engine ECU stops he high-pressure (I). At this time, it controls the control duty to 0%.

In S260, the engine ECU increments the variable I by 1. In S270, the engine ECU determines whether the variable I is equal to or greater than the number N of pumps. If the variable I≧the number N of high-pressure fuel pumps (YES in S270), it is determined that failure diagnosis has been finished for all the high-pressure fuel pumps, and the process is ended. If not (NO in S270), the process returns to S210, and the failure diagnosis is carried out for the next high-pressure fuel pump. The process in S270 may be configured to determine whether the variable I=the number N of high-pressure fuel pumps.

As described above, according to the fuel supply system controlled by the engine ECU implementing the control device of the present modification, it is readily possible to locate a malfunctioning high-pressure fuel pump in the system formed of N high-pressure fuel pumps.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control device of a high-pressure fuel system of an internal combustion engine having a fuel injection mechanism for injecting a fuel into a cylinder, the high-pressure fuel system including a plurality of high-pressure fuel pumps driven by the internal combustion engine, the control device comprising:

a detection unit for detecting an amount of the fuel required to be discharged from said high-pressure fuel pumps; and a control unit for controlling said plurality of high-pressure fuel pumps such that the fuel discharged from said plurality of high-pressure fuel pumps is supplied to a plurality of such fuel injection mechanisms, said control unit including a discharge ratio determination portion that determines a fuel discharge ratio among said plurality of high-pressure fuel pumps in accordance with said amount of the fuel required to be discharged.

2. The control device of a high-pressure fuel system of an internal combustion engine according to claim 1, further comprising a storage unit for storing a characteristic of each of said high-pressure fuel pumps, wherein said discharge ratio determination portion determines the fuel discharge ratio among said plurality of high-pressure fuel pumps in accordance with said amount of the fuel required to be discharged, based on said characteristics.

3. The control device of a high-pressure fuel system of an internal combustion engine according to claim 1, wherein said discharge ratio determination portion calculates an amount of the fuel to be discharged from each of said high-pressure fuel pumps based on said fuel discharge ratio, and calculates a drive duty of each of said high-pressure fuel pumps based on said amount of the fuel to be discharged therefrom.

4. The control device of a high-pressure fuel system of an internal combustion engine according to claim 1, wherein said discharge ratio determination portion determines the fuel discharge ratio among said plurality of high-pressure fuel pumps in accordance with said amount of the fuel required to be discharged, with an amount of the fuel relieved from said high-pressure fuel pumps being taken into account.

5. The control device of a high-pressure fuel system of an internal combustion engine according to claim 4, wherein said control unit determines whether it is possible to stop discharge of the fuel from at least one of said high-pressure fuel pumps in accordance with said amount of the fuel required to be discharged.

6. The control device of a high-pressure fuel system of an internal combustion engine according to claim 1, wherein said control unit controls said high-pressure fuel pumps such that discharge of the fuel from at least one of said high-pressure fuel pumps is stopped when fuel injection from said fuel injection mechanism is stopped.

7. The control device of a high-pressure fuel system of an internal combustion engine according to claim 1, wherein when said plurality of high-pressure fuel pumps include a high-pressure fuel pump having a different discharge characteristic, said discharge ratio determination portion determines the fuel discharge ratio among said plurality of high-pressure fuel pumps such that the amount of the fuel discharged from the high-pressure fuel pump having the different discharge characteristic is approximately equal to the amount of the fuel discharged from another one of said high-pressure fuel pumps.

8. The control device of a high-pressure fuel system of an internal combustion engine according to any of claims 1–7, wherein when at least one of said plurality of high-pressure fuel pumps has a maximum possible discharge amount that is smaller than said amount of the fuel required to be discharged, said discharge ratio determination portion determines the fuel discharge ratio among said plurality of high-pressure fuel pumps such that the high-pressure fuel pump having its maximum possible discharge amount smaller than said amount of the fuel required to be discharged will discharge the fuel of the maximum possible discharge amount and that another one of said high-pressure fuel pumps will discharge the fuel of the amount corresponding to a difference between said amount of the fuel required to be discharged and said maximum possible discharge amount.

9. The control device of a high-pressure fuel system of an internal combustion engine according to claim 1. further comprising:

an operation unit for activating said plurality of high-pressure fuel pumps one by one using a predetermined drive duty; and a determination unit for determining whether the pump is faulty or not based on a change in fuel pressure as a result of said activation.

10. The control device of a high-pressure fuel system of an internal combustion engine according to claim 9, wherein said determination unit determines whether the pump is faulty or not based on a degree of increase of said fuel pressure.

11. A control device of a high-pressure fuel system of an internal combustion engine having fuel injection means for injecting a fuel into a cylinder, the high-pressure fuel system including a plurality of high-pressure fuel pumps driven by the internal combustion engine, the control device comprising:

detection means for detecting an amount of the fuel required to be discharged from said high-pressure fuel pumps; and control means for controlling said plurality of high-pressure fuel pumps such that the fuel discharged from said plurality of high-pressure fuel pumps is supplied to a plurality of such fuel injection means, said control means including discharge ratio determination means for determining a fuel discharge ratio among said plurality of high-pressure fuel pumps in accordance with said amount of the fuel required to be discharged.

12. The control device of a high-pressure fuel system of an internal combustion engine according to claim 11, further comprising storage means for storing a characteristic of each of said high-pressure fuel pumps, wherein said discharge ratio determination means includes means for determining the fuel discharge ratio among said plurality of high-pressure fuel pumps in accordance with said amount of the fuel required to be discharged, based on said characteristics.

13. The control device of a high-pressure fuel system of an internal combustion engine according to claim 11, wherein said discharge ratio determination means includes p1 means for calculating an amount of the fuel to be discharged from each of said high-pressure fuel pumps based on said fuel discharge ratio, and means for calculating a drive duty of each of said high-pressure fuel pumps based on said amount of the fuel to be discharged therefrom.

14. The control device of a high-pressure fuel system of an internal combustion engine according to claim 11, wherein said discharge ratio determination means includes means for determining the fuel discharge ratio among said plurality of high-pressure fuel pumps in accordance with said amount of the fuel required to be discharged, with an amount of the fuel relieved from said high-pressure fuel pumps being taken into account.

15. The control device of a high-pressure fuel system of an internal combustion engine according to claim 14, wherein said control means further includes means for determining whether it is possible to stop discharge of the fuel from at least one of said high-pressure fuel pumps in accordance with said amount of the fuel required to be discharged.

16. The control device of a high-pressure fuel system of an internal combustion engine according to claim 11, wherein said control means further includes means for controlling said high-pressure fuel pumps such that discharge of the fuel from at least one of said high-pressure fuel pumps is stopped when fuel injection from said fuel injection means is stopped.

17. The control device of a high-pressure fuel system of an internal combustion engine according to claim 11, wherein said discharge ratio determination means includes means for determining the fuel discharge ratio among said plurality of high-pressure fuel pumps such that, when said plurality of high-pressure fuel pumps include a high-pressure fuel pump having a different discharge characteristic, the amount of the fuel discharged from the high-pressure fuel pump having the different discharge characteristic is approximately equal to the amount of the fuel discharged from another one of said high-pressure fuel pumps.

18. The control device of a high-pressure fuel system of an internal combustion engine according to any of claims 1–7, wherein said discharge ratio determination means includes means for determining the fuel discharge ratio among said plurality of high-pressure fuel pumps such that, when at least one of said plurality of high-pressure fuel pumps has a maximum possible discharge amount that is smaller than said amount of the fuel required to be discharged, the high-pressure fuel pump having its maximum possible discharge amount smaller than said amount of the fuel required to be discharged will discharge the fuel of the maximum possible discharge amount and that another one of said high-pressure fuel pumps will discharge the fuel of the amount corresponding to a difference between said amount of the fuel required to be discharged and said maximum possible discharge amount.

19. The control device of a high-pressure fuel system of an internal combustion engine according to claim 11, further comprising:

operation means for activating said plurality of high-pressure fuel pumps one by one using a predetermined drive duty; and determination means for determining whether the pump is faulty or not based on a change in fuel pressure as a result of said activation.

20. The control device of a high-pressure fuel system of an internal combustion engine according to claim 19, wherein said determination means includes means for determining whether the pump is faulty or not based on a degree of increase of said fuel pressure.

* * * * *